United States Patent [19]

Bowden et al.

[11] 4,077,197

[45] Mar. 7, 1978

[54] OPEN END SPINNING

[75] Inventors: Woodrow Raleigh Bowden, Melbourne; William H. Hills, Melbourne Village; Frank Edward Winner, South Merritt Island, all of Fla.

[73] Assignee: Monsanto Company, St. Louis, Mo.

[21] Appl. No.: 703,885

[22] Filed: Jul. 9, 1976

[51] Int. Cl.[2] ..... D01H 1/12

[52] U.S. Cl. ..... 57/156; 57/58.89; 57/77.3

[58] Field of Search ..... 57/58.89, 58.95, 77.3–77.45, 57/156

[56] References Cited

U.S. PATENT DOCUMENTS

| | | | |
|---|---|---|---|
| 3,696,603 | 10/1972 | Kotter et al. | 57/58.89 |
| 3,768,243 | 10/1973 | Brown et al. | 57/58.89 |
| 3,826,073 | 7/1974 | Hoeber et al. | 57/77.33 |
| 3,901,012 | 8/1975 | Safar | 57/58.89 |
| 3,945,185 | 3/1976 | Nakamura et al. | 57/58.95 |
| 3,981,137 | 9/1976 | Fehrer | 57/156 |
| 3,994,120 | 11/1976 | Radom et al. | 57/58.89 |

*Primary Examiner*—Richard C. Queisser
*Assistant Examiner*—Charles Gorenstein
*Attorney, Agent, or Firm*—Kelly O. Corley

[57] ABSTRACT

In an open-end spinning process wherein staple fibers are continuously fed to an air vortex and wherein a yarn tail extends into the vortex whereby the fibers affix themselves to and lengthen the tail, the yarn tail is driven at a faster revolution rate than the tail would be driven by the vortex alone by means of a rotary driven member.

4 Claims, 5 Drawing Figures

FIG. 3.
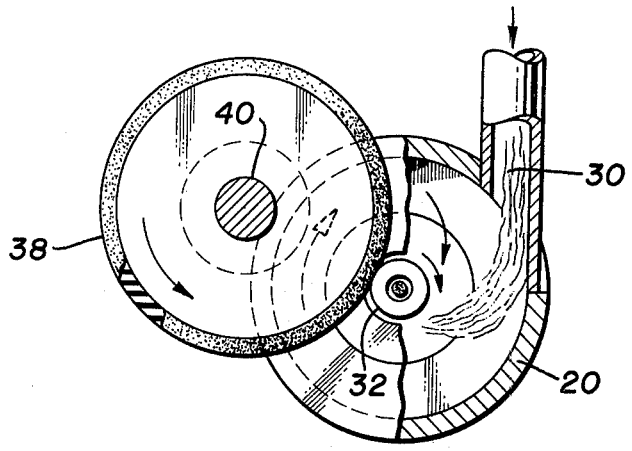
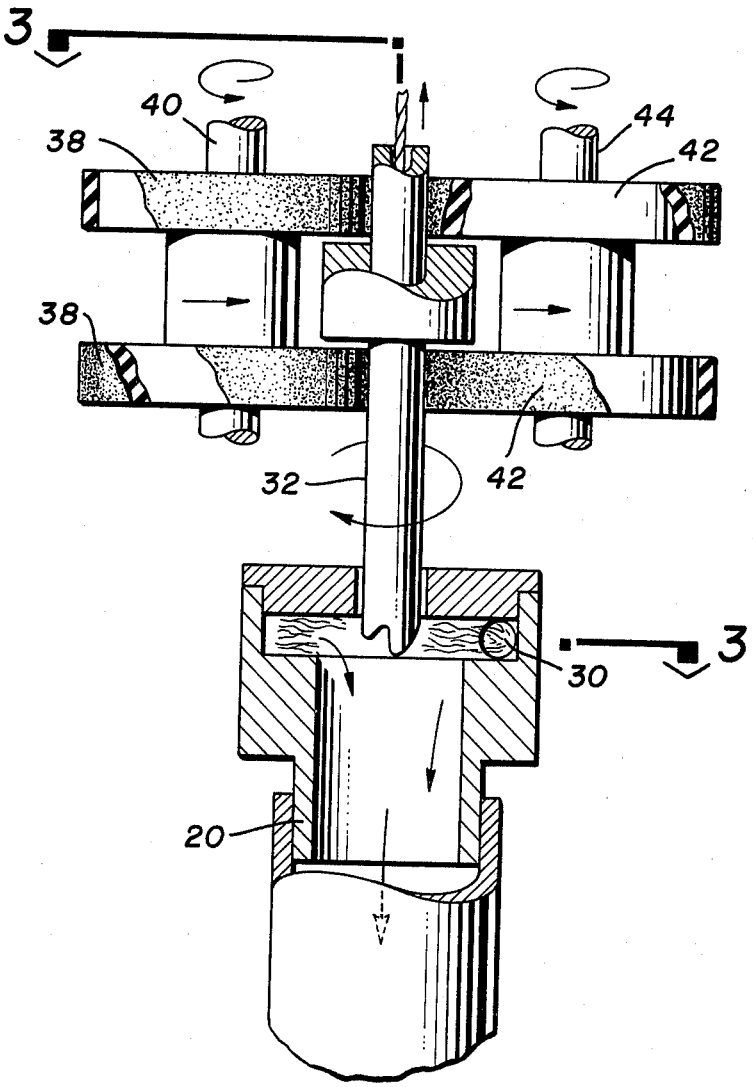
FIG. 4.

OPEN END SPINNING

The invention relates to the art of open-end spinning of yarns from staple fibers. More particularly, the invention relates to such spinning wherein the fibers are suspended in an air vortex rotating about an axis with the yarn free end or tail rotating in the vortex whereby the loose fibers affix themselves to and lengthen the tail.

Conventional yarn spinning using a ring-and-traveller system has various disadvantages, among which are low yarn production speeds and limited package size. Twist insertion is limited to about 10,000 turns per minute due to limitations on traveller speed, which, at 10 turns per inch (393.7 turns per meter), would provide for a yarn speed of 1000 inches per minute (25.4 meters per minute). Package diameter is limited by the ring diameter.

Open-end spinning affords higher yarn speeds and no particular limit on package diameter, as well as permitting a continuous operation wherein bobbins may be doffed or changed without the necessity of stopping yarn formation. Various methods and apparatus are known wherein fibers are transported pneumatically to an air vortex with the yarn tail extending into the vortex whereby the fibers affix themselves to and lengthen the tail. One such disclosure of known methods and apparatus in U.S. Pat. No. 3,851,455 to Jozwicki et al, the disclosure of which is incorporated herein by reference. In the Jozwicki patent staple fibers are fed into an axially stationary air vortex, resulting in a ring of fibers rotating about the vortex axis. A yarn free end or tail is introduced into the vortex from a point along the vortex axis. The combined effects of centrifugal force and the rotating vortex cause the yarn tail to rotate in the vortex with the end of the tail in the ring of fibers. The fibers in the ring become intertwined with and affix themselves to the yarn tail whereby the yarn is lengthened. While the Jozwicki methods and apparatus perform satisfactorily for making certain types of yarn, they are limited in yarn speed and in the amount of twist that can be imparted to yarns because the yarn tail is driven only by the air vortex.

According to a first aspect of the invention, these and other difficulties are avoided by a process comprising forming an air vortex spaced from and rotating about an axis, continuously feeding staple fibers into the vortex, rotating a yarn tail in the vortex at a faster revolution rate than the tail would be driven by the vortex alone whereby the fibers affix themselves to and lengthen the yarn tail, and continuously withdrawing the yarn from the vortex.

According to another aspect of the invention, the vortex is axially stationary.

According to another aspect of the invention, the step of rotating comprises passing the yarn through a hollow tube rotating about the axis of the vortex.

According to another aspect of the invention, the hollow tube comprises an abutment for driving the yarn.

According to another aspect of the invention, the hollow tube comprises a frictional surface for driving the yarn.

These and other aspects are set forth in the following detailed disclosure taken in connection with the accompanying drawings, wherein:

FIG. 3 is a plan view, partly broken away, of another embodiment of the invention;

FIG. 4 is a sectional view taken along line 3—3 in FIG. 4; and

Figure 1:
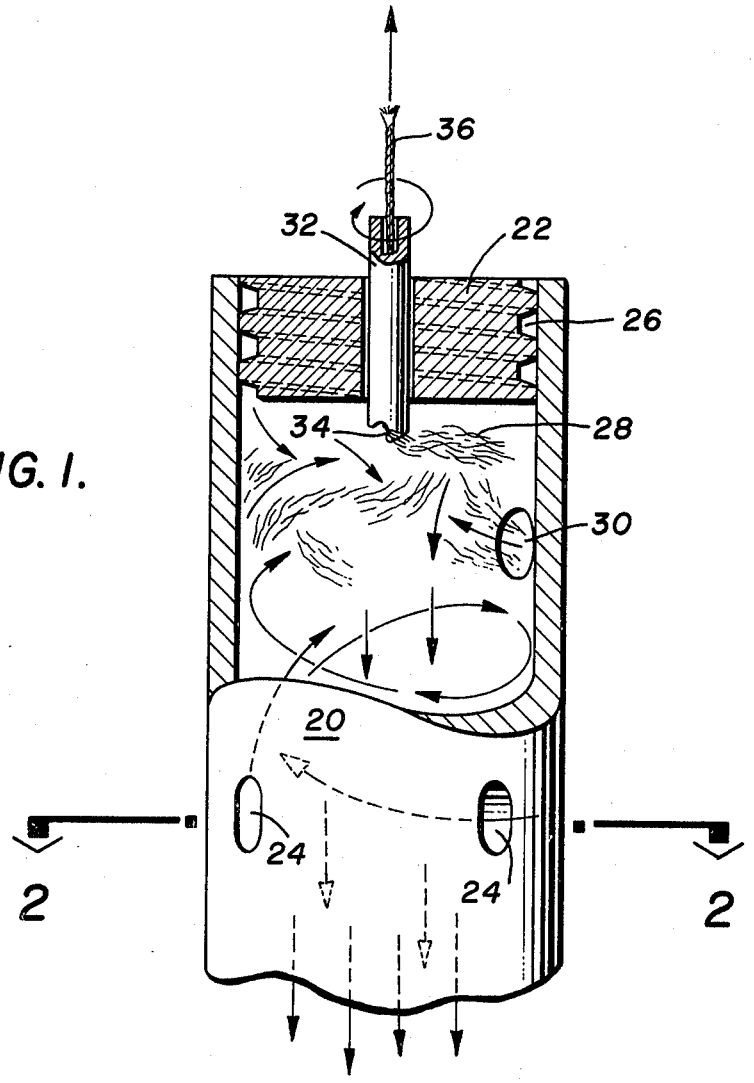
FIG. 1 is a vertical sectional view of the preferred embodiment of the invention.
Figure 2:
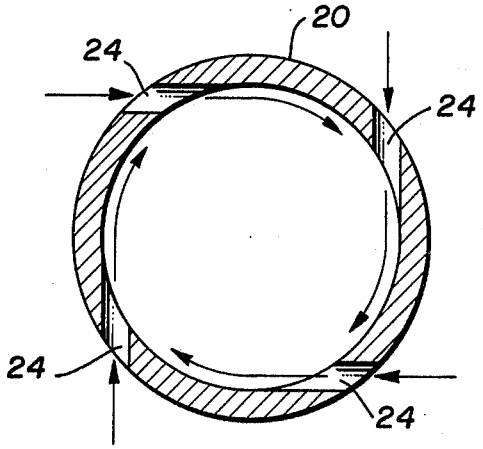
FIG. 2 is a sectional view taken along line 2—2 in FIG. 1.

FIG. 1 shows the preferred embodiment of the invention as applied to open-end spinning apparatus of the general types disclosed in Jozwicki U.S. Pat. No. 3,851,455, and specifically as shown in FIGS. 1-3 therein. The apparatus comprises right circularly cylindrical chamber 20 having its upper end partially closed by plug 22. A suction is applied at the lower end of chamber 20. As best viewed in FIGS. 1 and 2, air is admitted tangentially into chamber 20 through ports 24, causing formation of air vortices spiralling upwardly within chamber 20. A helical air groove 26 is formed in the periphery of plug 22, which likewise admits air into chamber 20 in a vortex spiralling downwardly and rotating in the same direction as the vortices originating from ports 24. The upwardly and downwardly spiralling vortices meet forming an axially stationary vortex 28 spaced from and rotating about the axis of chamber 20. Air and fibers are continuously fed into chamber 20 through inlet port 30 located in the upwardly spiralling vortices from ports 24, whereby the fibers are continuously fed to axially stationary vortex 28.

A spindle 32 in the form of a hollow tube extends through an opening in plug 22 and coaxially with the axis of chamber 20. Spindle 32 is driven to rotate about its axis in the same direction as the vortices, and terminates at or near the center about which vortex 28 rotates. The lower end of spindle 32 is formed in the shape of a spiral cam, terminating in a shoulder or abutment 34 for driving the yarn tail.

Seed yarn 36 is inserted downwardly through spindle 32. The free end or tail of yarn 36 is flung outwardly from the axis of spindle 32 by centrifugal force until it enters the whirling ring of fibers suspended in vortex 28, the yarn tail being contacted and driven by abutment 34 at a faster revolution rate than the yarn tail would be driven by vortex 28 alone. The individual fibers in the whirling ring entangle with and affix themselves to the yarn tail, continuously lengthening the yarn tail. Consequently yarn 36 may be continuously withdrawn from vortex 28.

Since the yarn tail is driven at a faster revolution rate than it would be by vortex 28 alone, more turns of twist per unit of time are imparted to the yarn. With equal rates of yarn withdrawal, more twist can thus be imparted to the yarn. Using the relatively low spindle speed of 72,000 RPM, about 69% more twist per meter of yarn has been imparted with the yarn driven by abutment 34 than when operating without rotation of spindle 32, both experiments being run at 137 meters per minute yarn withdrawal speed. Much higher spindle speeds and yarn speeds are readily attainable, the above specific speeds being merely exemplary.

FIGS. 3 and 4 illustrate a different embodiment of chamber 20. In this embodiment, ports 24 have been eliminated, chamber 20 has a region of greater diameter adjacent plug 22, and port 30 (admitting both air and fibers) is located in the region of greater diameter. This simplified construction of chamber 20 will, however, ordinarily produce a greater loss of fibers to the suction source than the FIG. 1 embodiment.

A suitable mechanism for driving spindle 32 is likewise shown in FIGS. 3 and 4. Since this mechanism is identical in principle with conventional mechanisms for driving false twist spindles, it will not be described in detail. Briefly, a non-illustrated magnet urges spindle 32 into contact with the peripheries of drive discs 38 mounted on shaft 40 and with the peripheries of drive discs 42 mounted on shaft 44. Since the drive discs have much larger diameters than spindle 32, they may rotate at quite modest revolution rates while driving spindle 32 at very high revolution rates. Spindle drives with similar constructions are reported to attain spindle speeds of the order of magnitude of 1,000,000 revolutions per minute.

Figure 5:
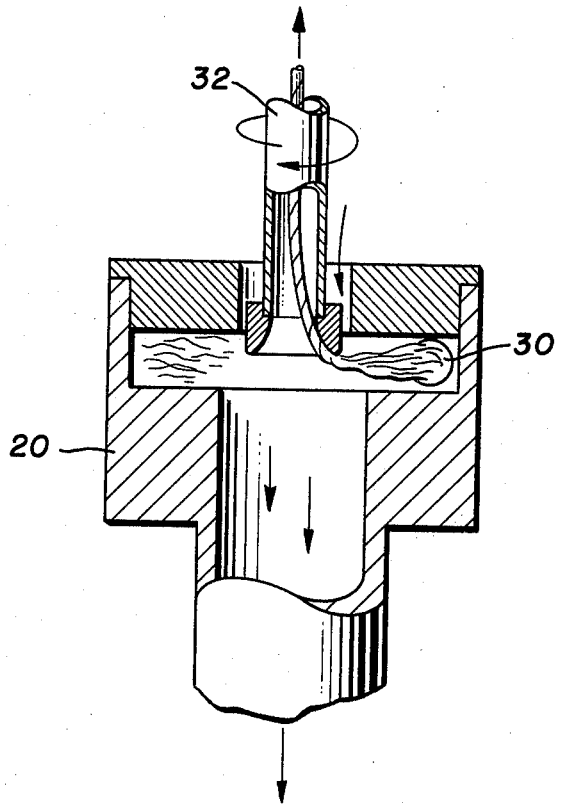
FIG. 5 is a fragmentary sectional view similar to a portion of FIG. 4, showing a different type of means for driving the yarn tail.

FIG. 5 illustrates another embodiment of spindle 32, wherein the lower end of the spindle is modified to the form of a trumpet having a frictional surface for engaging the yarn. The trumpet surface is preferably formed from a wear resistant material having a high coefficient of friction with the yarn. Preferred materials are polyurethane and ceramic. Centrifugal force holds the yarn against the wall of the trumpet, providing a rolling of the yarn on the trumpet. This makes possible the addition of more turns of twist per revolution of spindle 32 than in the case of the abutment 34 design of FIG. 1.

It should be noted that the above specifically described embodiments are merely exemplary, and do not portray the limits of the invention.

For example, some of the objects of the invention would be obtained with different chamber designs, such as one wherein the fibers were fed into and picked up from a spiralling vortex, even though fiber loss would be considerably greater in such a case. Likewise some of the objects of the invention could be obtained with other means and methods of driving the yarn tail in the vortex.

We claim:

1. A process for forming a yarn, comprising a. forming an air axially stationary vortex spaced from and rotating about an axis;

b. continuously feeding staple fibers into said vortex;

c. driving a yarn tail in said vortex at a faster revolution rate than said tail would be driven by said vortex alone whereby said fibers affix themselves to and lengthen said yarn tail; and d. continuously withdrawing said yarn from said vortex.

2. The process defined in claim 1, wherein said step of driving comprises passing said yarn through a hollow tube rotating about the axis of said vortex.

3. The process defined in claim 2, wherein said hollow tube comprises an abutment for driving said yarn.

4. The process defined in claim 2, wherein said hollow tube comprises a frictional surface for driving said yarn.

* * * * *